US010824086B1

(12) United States Patent
Kato

(10) Patent No.: US 10,824,086 B1
(45) Date of Patent: Nov. 3, 2020

(54) IMAGE FORMING APPARATUS INCLUDING A CLEANING MEMBER THAT HAS A SPIRAL PORTION OF DIFFERENT EDGE SURFACE WIDTHS AMONG DIFFERENT REGIONS

(71) Applicant: TOSHIBA TEC KABUSHIKI KAISHA, Tokyo (JP)

(72) Inventor: Tomoyuki Kato, Tagata Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/580,341

(22) Filed: Sep. 24, 2019

(51) Int. Cl.

| | |
|---|---|
| ***G03G 15/02*** | (2006.01) |
| ***G03G 21/18*** | (2006.01) |
| ***G03G 21/16*** | (2006.01) |
| ***G03G 21/00*** | (2006.01) |

(52) U.S. Cl.
CPC ..... *G03G 15/0225* (2013.01); *G03G 21/0058* (2013.01); *G03G 21/169* (2013.01); *G03G 21/1814* (2013.01); *G03G 2221/0005* (2013.01)

(58) Field of Classification Search
USPC ..... 399/99
See application file for complete search history.

(56) References Cited

U.S. PATENT DOCUMENTS

2011/0170901 A1* 7/2011 Kawai ..... G03G 15/0258 399/100
2017/0219988 A1* 8/2017 Yada ..... G03G 21/0058
2017/0219989 A1* 8/2017 Yada ..... G03G 21/0058

FOREIGN PATENT DOCUMENTS

JP 2007127770 A * 5/2007
JP 2017-078817 A 4/2017

* cited by examiner

*Primary Examiner* — Quana Grainger
(74) *Attorney, Agent, or Firm* — Kim & Stewart LLP

(57) ABSTRACT

An image forming apparatus includes a photoconductive drum, a charging roller, and a cleaning member. The charging roller is positioned to contact a surface of the photoconductive drum and configured to charge the surface of the photoconductive drum. The cleaning member is configured to contact a surface of the charging roller. The cleaning member includes a shaft extending along a rotational axis and a spiral portion spiraling around the shaft along a length of the shaft parallel to the rotational axis. A width of the spiral portion at a central region of the cleaning member is greater than a width of the spiral portion at an end region of the cleaning member.

18 Claims, 6 Drawing Sheets

IMAGE FORMING APPARATUS INCLUDING A CLEANING MEMBER THAT HAS A SPIRAL PORTION OF DIFFERENT EDGE SURFACE WIDTHS AMONG DIFFERENT REGIONS

FIELD

Embodiments described herein relate generally to an image forming apparatus.

BACKGROUND

An image forming apparatus includes one or more image forming units. An image forming unit includes a photoconductive body, a charging device, an optical device, a developing device, and a transfer device. The charging device includes a charging roller and a cleaning roller. The cleaning roller contacts the charging roller and cleans the surface of the charging roller. It is desirable to sufficiently clean the surface of the cleaning roller.

DETAILED DESCRIPTION

Figure 1:
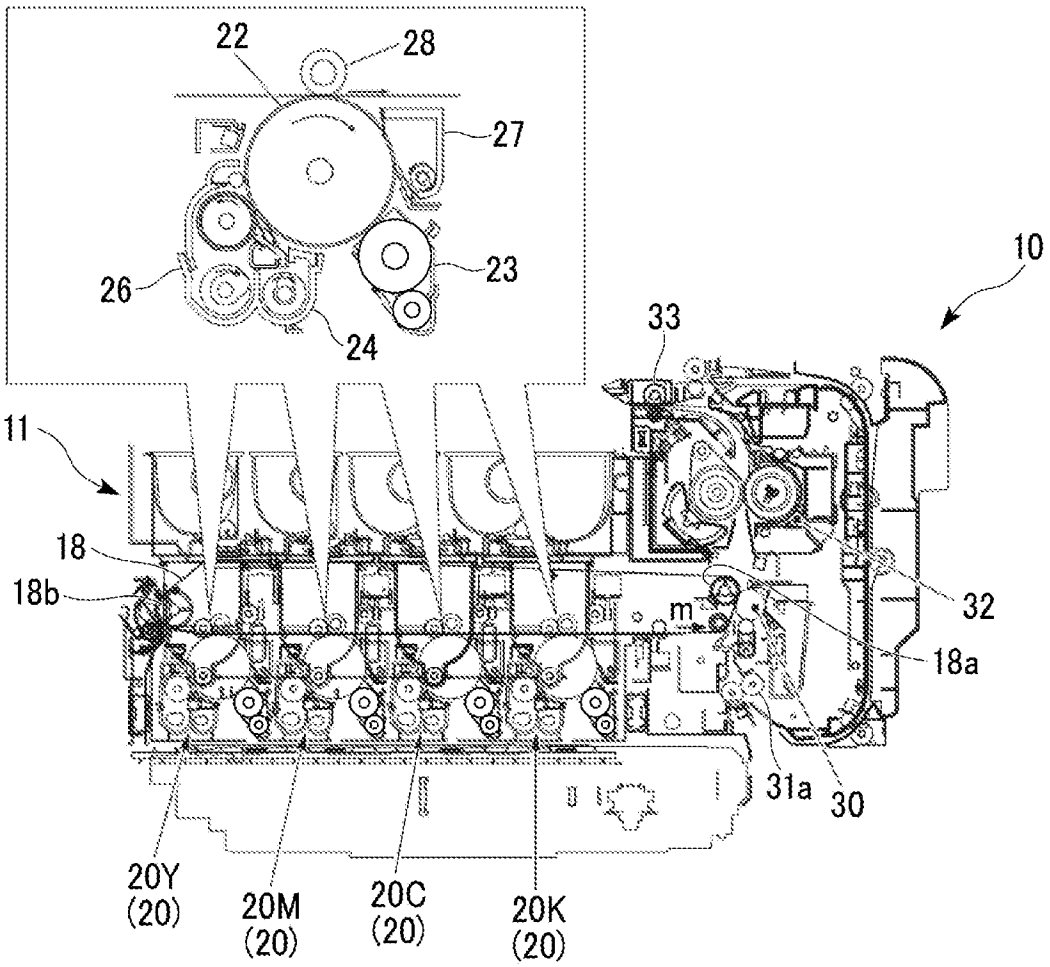
FIG. 1 depicts an image forming apparatus including image forming units according to a first embodiment.

An image forming apparatus according to an embodiment includes a photoconductive drum on which a toner image is to be formed; a charging roller positioned to contact a surface of the photoconductive drum and configured to charge the surface of the photoconductive drum; and a cleaning member configured contact a surface of the charging roller. The cleaning member includes a shaft extending along a rotational axis and a spiral portion spiraling around the shaft along a length of the shaft parallel to the rotational axis. A width of the spiral portion at a central region of the cleaning member is greater than a width of the spiral portion at an end region of the cleaning member. In general, the spiral portion satisfies at least one of following conditions: (1) A width of the spiral portion at the central region, along the rotational axis length, is greater than a width of the spiral portion at the end region(s) along the rotational axis length; (2) A pitch of the spiral portion at the central region is less than a pitch of the spiral portion at the end region(s).

Image forming units and image forming apparatuses according to example embodiments are described below with reference to the drawings. In the figures, the same components are denoted by the same reference numerals and symbols. For clarity in description, in some instances of the figures, dimensions and shapes of components may be exaggerated or simplified.

FIG. 1 is a configuration diagram of an image forming apparatus 10 including image forming stations 20. The image forming stations 20 are examples of image forming units according to a first embodiment.

As illustrated in FIG. 1, the image forming apparatus 10 includes a printer section 11, which is an image forming section. The printer section 11 includes four image forming stations 20. The four image forming stations 20 are the image forming stations 20Y, 20M, 20C, and 20K that respectively use toners of Y (yellow), M (magenta), C (cyan), and K (black). The image forming stations 20Y, 20M, 20C, and 20K are disposed in parallel along an intermediate transfer belt 18.

The image forming station 20 includes a photoconductive drum 22, an electrostatic charger 23, an exposure scanning head 24, a developing device 26, and a photoconductive cleaner 27.

In the photoconductive drum 22, also referred to as a photoconductive body, a photoconductive layer is coated on the surface of a conductive cylindrical supporting body. The electrostatic charger 23, also referred to as ac charging device, applies electric charge to the photoconductive drum 22 to charge the surface of the photoconductive drum 22. The exposure scanning head 24, which is also referred to as an optical device, irradiates the photoconductive drum 22 with light to form an exposed latent image. The developing devices 26 of the image forming stations 20Y, 20M, 20C, and 20K respectively include two-component developers including the toners of Y (yellow), M (magenta), C (cyan), and K (black) and a carrier. The developing device 26 develops the exposed latent image with the developer. The photoconductive cleaner 27 removes the toners remaining on the photoconductive drum 22.

The printer section 11 includes a backup roller 18*a*, a driven roller 18*b*, a tension roller, the intermediate transfer belt 18, a plurality of primary transfer rollers 28, and a secondary transfer roller 30. The backup roller 18*a*, the driven roller 18*b*, and the tension roller support the intermediate transfer belt 18. The intermediate transfer belt 18 rotates in an arrow m direction. The primary transfer rollers 28 are respectively provided in positions opposed to the photoconductive drum 22 via the intermediate transfer belt 18. The secondary transfer roller 30 is provided in a position opposed to the backup roller 18*a* via the intermediate transfer belt 18.

A paper feeding section that supplies sheets is provided below the printer section 11. The printer section 11 includes a registration roller 31*a*, a fixing device 32, and a paper discharge roller pair 33. The registration roller 31*a*, the secondary transfer roller 30, the fixing device 32, and the paper discharge roller pair 33 are provided in a conveyance path on which the sheets are conveyed.

The primary transfer roller 28 primarily transfers a toner image formed on the photoconductive drum 22 onto the intermediate transfer belt 18. The primary transfer rollers 28 of the image forming stations 20Y, 20M, 20C, and 20K sequentially superimpose toner images of Y (yellow), M (magenta), C (cyan), and K (black) to form a color toner image on the intermediate transfer belt 18.

The secondary transfer roller 30 rotates following the intermediate transfer belt 18. The secondary transfer roller secondarily transfers the color toner image on the intermediate transfer belt 18 onto the supplied sheet.

Figure 2:
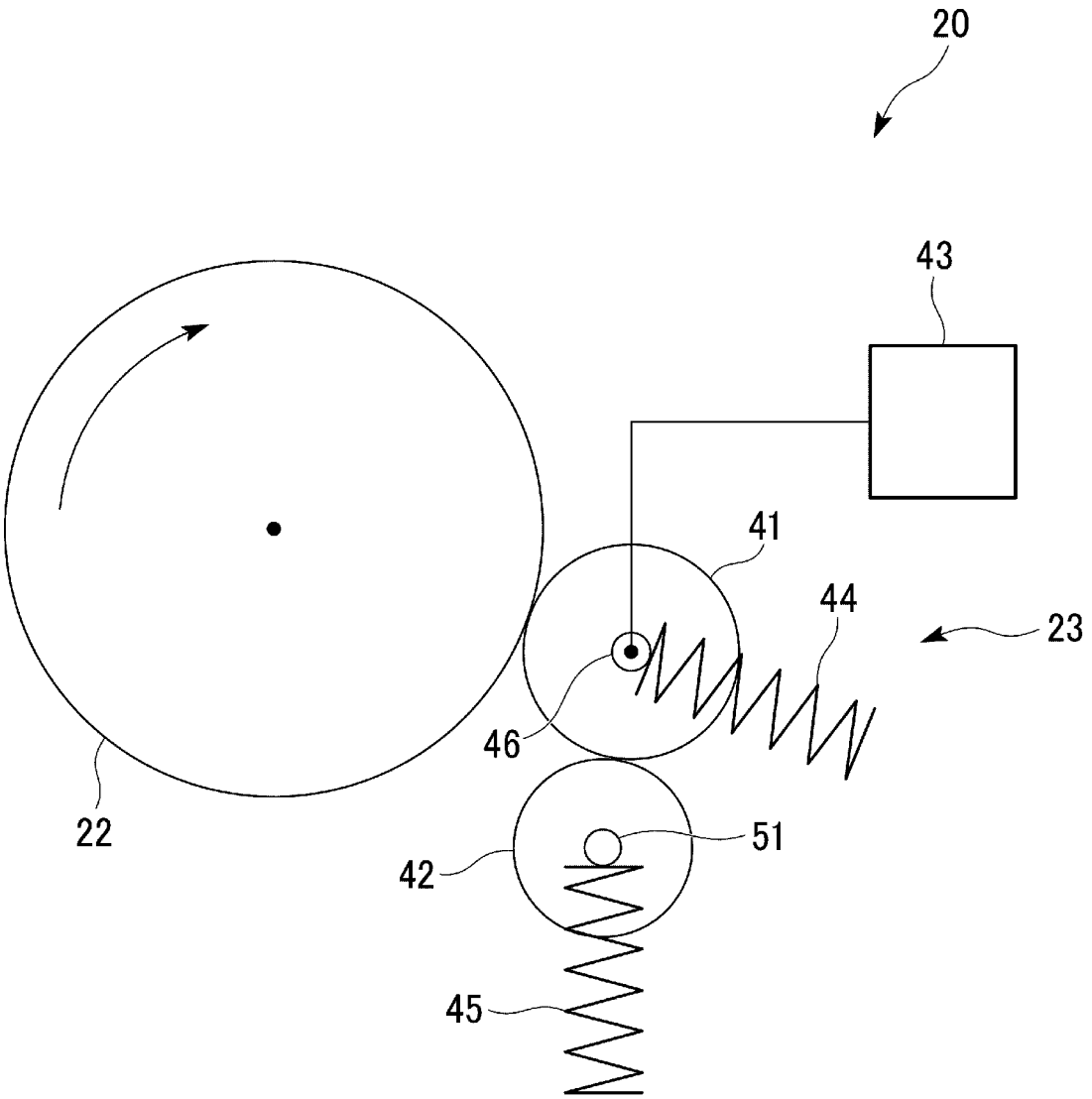
FIG. 2 depicts a charging device of an image forming unit.
Figure 3:
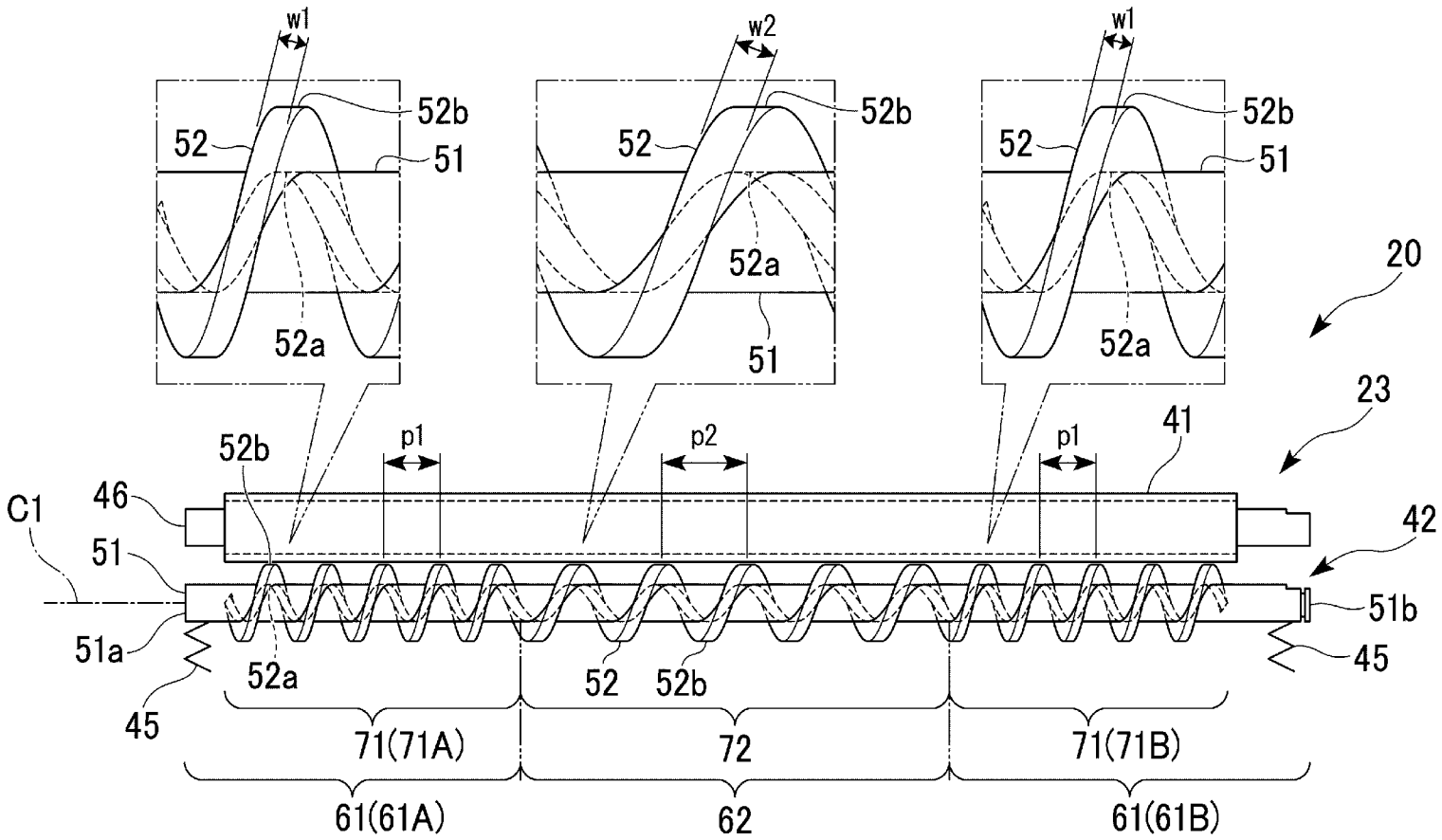
FIG. 3 illustrates a front view of the charging device.

The structure of the electrostatic charger 23 is described in detail below. FIG. 2 is a configuration diagram of the electrostatic charger 23. FIG. 3 illustrates a front view of the electrostatic charger 23.

As illustrated in FIG. 2, the electrostatic charger 23 includes a charging roller 41, a cleaning member 42, a power supply 43, a first urging body 44, and second urging bodies 45. The charging roller 41 is applied with a voltage by the power supply 43 and charged. The voltage applied to the charging roller 41 by the power supply 43 may be a DC voltage or may be a voltage obtained by superimposing an AC voltage on the DC voltage. If the DC voltage is adopted, cost can be reduced. If an AC superimposing system is adopted, stable charging can be obtained.

The charging roller 41 rotates according to rotation of the photoconductive drum 22. Electric discharge occurs across a very small space between the charging roller 41 and the photoconductive drum 22, whereby the surface of the photoconductive drum 22 is charged.

As illustrated in FIG. 3, the cleaning member 42 includes a shaft section 51 and a contact member 52.

The shaft section 51 is formed in a circular shape in a cross section orthogonal to the center axis direction of the shaft section 51. The shaft section 51 has a fixed outer diameter. The line C1 (center axis C1) indicates the center axis of the shaft section 51. For example, the shaft section 51 is desirably made of a metal material such as stainless steel or a free-cutting steel material. If the shaft section 51 is made of metal material, sufficient mechanical strength can be given to the shaft section 51. Therefore, it is possible to prevent a bending of the shaft section 51 during cleaning. If the shaft section 51 is made of the metal material to have the fixed outer diameter, cost can be reduced.

The outer diameter of the shaft section 51 is desirably 4 mm to 6 mm. If the outer diameter of the shaft section 51 is 4 mm or more, sufficient mechanical strength can be given to the shaft section 51. Therefore, it is possible to prevent a bending of the shaft section 51 during cleaning. If the outer diameter of the shaft section 51 is 6 mm or less, manufacturing cost can be reduced. The length of the shaft section 51 is desirably 250 mm or more. If the length of the shaft section 51 is 250 mm or more, it is possible to clean a wide range of the charging roller 41 using a single cleaning member 42. Therefore, the structure of the electrostatic charger 23 can be simplified.

The shaft section 51 is disposed along the length direction of the charging roller 41. The shaft section 51 is disposed in parallel to the charging roller 41.

The contact member 52 is a wire body member spirally formed around the center axis C1 on an outer circumferential surface of the shaft section 51, and may be referred to as a spiral portion. A traveling distance in the length direction of the shaft section 51 (the center axis C1 direction) at the time when a twisting angle around the center axis C1 of the contact member 52 changes 360° is referred to as "pitch". For example, a track of the contact member 52 can be represented as $x=r\cos\theta$ (an X coordinate), $y=r\sin\theta$ (a Y coordinate), and $z=a\theta$ (a Z coordinate) in an XYZ rectangular coordinate system, where r is a constant and is the distance between the contact member 52 and the center axis C1 on an XY plane, θ is a rotation angle centering on the center axis C1, and the value "a" is a constant and can be any real number.

A cross-sectional shape of the contact member 52 orthogonal to its length direction is, for example, substantially rectangular, that is, thin slices of the contact member 52 are substantially rectangular. An inner circumferential surface 52*a* of the contact member 52 is in contact with the outer circumferential surface of the shaft section 51 over the entire length of the contact member 52. The contact member 52 spirals along the length direction of the shaft section 51. An outer circumferential surface 52*b* of the contact member 52 can come into contact with an outer circumferential surface of the charging roller 41. The contact member 52 projects from the outer circumferential surface of the shaft section 51 in a radial outward direction.

The contact member 52 is desirably an elastically compressible-deformable material. If the contact member 52 is elastically compressible-deformable, then the contact member 52 can come into contact with the charging roller 41 in a state in which the contact member 52 has been elastically deformed in the thickness direction of the contact member 52 (that is, the radial direction of the shaft section 51). Therefore, the contact member 52 comes into contact with the charging roller 41 while in a compressed state an provides a physically repulsive force against the charging roller 41. Accordingly, it is possible to improve contact between the contact member 52 and the charging roller 41 and improve a cleaning effect.

At least a surface layer portion of the contact member 52 is desirably made of resin (e.g., foamed resin or foam rubber). As the resin, melamine resin and polyurethane can be used. For example, foamed melamine resin and foamed polyurethane (foamed urethane) are suitable. As the resin, polystyrene and polyolefins (polyethylene, polypropylene, etc.) can also be used.

A distribution of widths of the outer circumferential surface 52*b* of the contact member 52 is described below.

The shaft section 51 can be divided into two end portion ranges 61 and one intermediate range 62. A first end portion range 61A of the two end portion ranges 61 is a length range including one end 51*a* (first end portion) of the shaft section 51. For example, the first end portion range 61A is a length range equivalent to 10% to 40% with respect to the entire length of the shaft section 51. The length range of the first end portion range 61A is desirably 25% to 40%.

A second end portion range 61B of the two end portion ranges 61 is a length range including the end 51*b* (second end portion) of the shaft section 51. For example, the second end portion range 61B is a length range equivalent to 10% to 40% with respect to the entire length of the shaft section 51. The length range of the second end portion range 61B is desirably 25% to 40%.

The length of the first end portion range 61A and the length of the second end portion range 61B may be the same or may be different from each other.

The intermediate range 62 is a length range between the two end portion ranges 61A and 61B. For example, the intermediate range 62 is a length range equivalent to 20% to 80% with respect to the entire length of the shaft section 51. The length range of the intermediate range 62 is desirably 33% to 50%.

In the contact member 52, portions formed in one of the end portion ranges 61 are referred to as "end side portions 71". In the contact member 52, portions formed in the first end portion range 61A and the second end portion range 61B are respectively referred to as a first end side portion 71A and a second end side portion 71B.

The width (hereinafter sometimes referred to as line width) of the outer circumferential surface 52*b* in the end side portions 71 is represented as "w1". The width of the outer circumferential surface 52*b* of the first end side portion 71A and the width of the outer circumferential surface 52*b* of the second end side portion 71B may be the same or may be different from each other. A pitch of the contact member 52 in the end side portions 71 is represented as "p1". A pitch of the first end side portion 71A and a pitch of the second end side portion 71B may be the same or may be different from each other.

For the contact member 52, a portion formed in the intermediate range 62 is referred to as "intermediate portion 72". The width (hereinafter sometimes referred to as line width) of the outer circumferential surface 52*b* of the contact member 52 in the intermediate portion 72 is represented as "w2". A pitch of the contact member 52 in the intermediate portion 72 is represented as "p2".

The line widths w1 and w2 may be averages of line widths of the outer circumferential surface 52*b* of the contact member 52 in the relevant ranges (the end portion ranges 61 and the intermediate range 62). The pitches p1 and p2 may be averages of pitches of the contact member 52 in the relevant ranges (e.g., the end portion ranges 61 and the intermediate range 62).

As illustrated in FIG. 2, one end of the first urging body 44 is connected to a shaft section 46 of the charging roller 41. The first urging body 44 presses the charging roller 41 in a direction towards the photoconductive drum 22. Therefore, the charging roller 41 is thus pressed against the photoconductive drum 22.

Each end portion of the shaft section 51 of the cleaning member 42 (see FIG. 3) is connected to an end of one of the second urging bodies 45. The second urging bodies 45 press both the end portions of the shaft section 51 in a direction towards the charging roller 41. Therefore, the cleaning member 42 is pressed against the charging roller 41. The cleaning member 42 rotates around the shaft section 51 in the opposite direction of a rotating direction of the charging roller 41.

As illustrated in FIGS. 2 and 3, the second urging bodies 45 press both the end portions of the shaft section 51. Therefore, a pressing force of the cleaning member 42 against the charging roller 41 is likely to be higher at both the end portions.

As illustrated in FIG. 3, in an image forming station 20, the line width w2 of the outer circumferential surface 52*b* of the intermediate portion 72 is larger than the line width w1 of the outer circumferential surfaces 52*b* of the end side portions 71. Consequently, even in the intermediate portion 72, it is possible to secure a contact area between the contact member 52 and the charging roller 41 and a pressing force of the contact member 52 against the charging roller 41. Therefore, it is possible to reduce deviations of the contact area and the pressing force of the contact member 52 along the length direction of the cleaning member 42. Therefore, it is possible to uniformly clean the charging roller 41 in a wide range along the length direction. Accordingly, it is possible to reduce image defects due to charging unevenness on the charging roller 41 and obtain satisfactory image quality. Since the charging roller 41 can be sufficiently cleaned, it is also possible to suppress the occurrence of noise due to resonance.

An area of the outer circumferential surface 52*b* per unit length of the contact member 52 in the intermediate portion 72 is desirably larger than an area of the outer circumferential surface 52*b* per unit length of the contact member 52 in at least one end side portion 71. Consequently, it is possible to reduce deviations of the contact area and the pressing force of the contact member 52 in the length direction of the cleaning member 42. Therefore, it is possible to sufficiently clean the charging roller 41 in a wide range in the length direction.

The cleaning member 42 can be easily manufactured by winding two kinds of contact members 52 having different line widths on the shaft section 51. Accordingly, the image forming station 20 is excellent in easiness of manufacturing and manufacturing cost.

If the voltage applied to the charging roller 41 by the power supply 43 illustrated in FIG. 2 is the DC voltage, toner, foreign matters, and the like tend to easily adhere to the charging roller 41. However, in the image forming station 20, the charging roller 41 can be maintained clean by the cleaning member 42.

Figure 4:
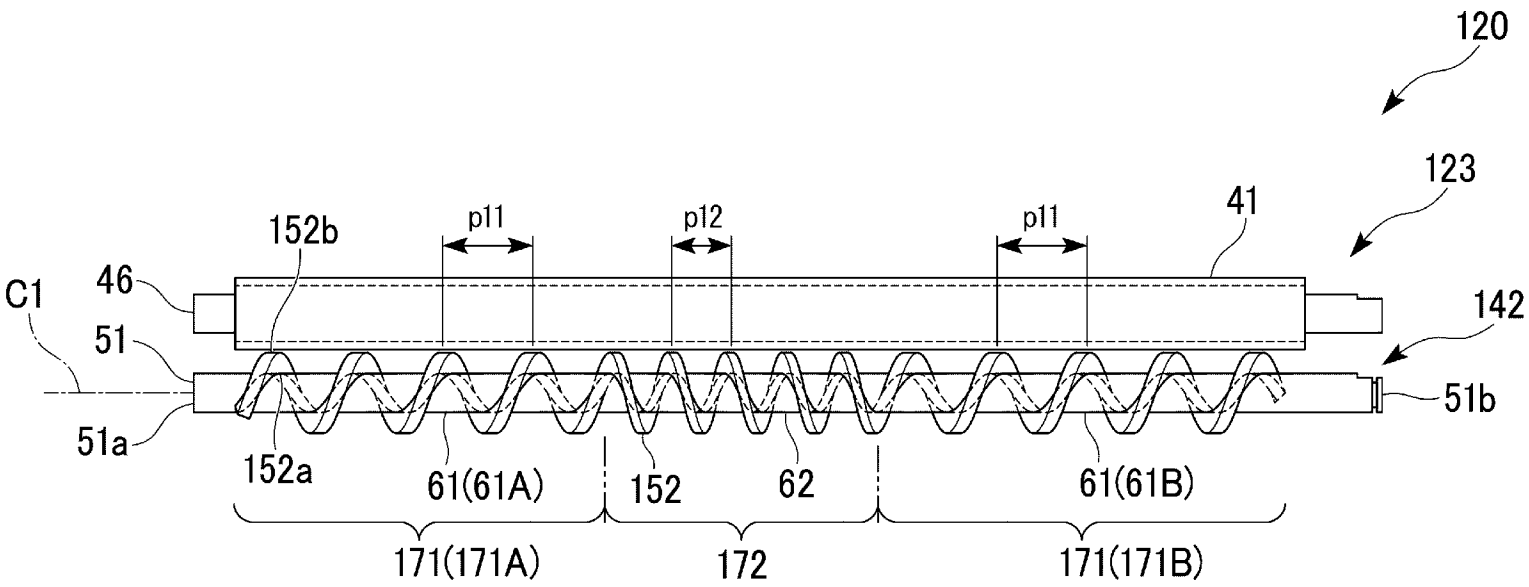
FIG. 4 illustrates a front view of a charging device of an image forming unit according to a second embodiment.

FIG. 4 illustrates a front view of an electrostatic charger 123 of an image forming station 120 according to a second embodiment. Description is omitted concerning components common to the first embodiment described above.

As illustrated in FIG. 4, a cleaning member 142 of the electrostatic charger 123 includes the shaft section 51 and a contact member 152.

A distribution of pitches of the contact member 152 is described below.

In the contact member 152, portions formed in the end portion ranges 61 are referred to as "end side portions 171". In the contact member 152, portions formed in the first end portion range 61A and the second end portion range 61B are respectively referred to as a first end side portion 171A and a second end side portion 171B. A pitch of the contact member 152 in the end side portions 171 is represented as "p11". A pitch of the first end side portion 171A and a pitch of the second end side portion 171B may be the same or may be different from each other.

In the contact member 152, a portion formed in the intermediate range 62 is referred to as "intermediate portion 172". A pitch of the contact member 52 in the intermediate portion 172 is referred to as "p12".

The pitch p12 of the intermediate portion 172 is smaller than the pitch p11 of at least one end side portion 171. The pitch p12 of the intermediate portion 172 only has to be smaller than the pitch p11 of any one end side portion 171. The pitch p12 of the intermediate portion 172 is desirably smaller than the pitch p11 of both the end side portions 171.

A magnitude relation between the line width of an outer circumferential surface 152*b* of the intermediate portion 172 and the line width of outer circumferential surfaces 152*b* of the end side portions 171 is not particularly limited. In FIG. 4, the line width of the outer circumferential surface 152*b* of the intermediate portion 172 is smaller than the line width of the outer circumferential surfaces 152*b* of the end side portions 171. The line width of the outer circumferential surface 152*b* of the intermediate portion 172 and the line width of the outer circumferential surfaces 152*b* of the end side portions 171 may be the same. The line width of the outer circumferential surface 152*b* of the intermediate portion 172 may be larger than the line width of the outer circumferential surfaces 152*b* of the end side portions 171.

In the image forming station 120, since the pitch p12 of the intermediate portion 172 is smaller than the pitch p11 of the end side portions 171, even in the intermediate portion 172, it is possible to secure a contact area of the contact member 152 with the charging roller 41 and a pressing force of the contact member 152 against the charging roller 41. Therefore, it is possible to reduce deviations of the contact area and the pressing force of the contact member 152. Therefore, it is possible to sufficiently clean the charging roller 41 in a wide range along the length direction. Accordingly, it is possible to reduce defects of images due to charging unevenness of the charging roller 41 and obtain satisfactory image quality. Since the charging roller 41 can be sufficiently cleaned, it is possible to suppress occurrence of noise due to resonance.

An area of the outer circumferential surface 152*b* per unit length of the contact member 152 in the intermediate portion 172 is desirably larger than an area of the outer circumferential surface 152*b* per unit length of the contact member 152 in at least one end side portion 171. Consequently, it is possible to reduce deviations of the contact area and the pressing force of the contact member 152 along the length direction of the cleaning member 142. Therefore, it is possible to sufficiently clean the charging roller 41 in a wide range in the length direction.

The cleaning member 142 can be manufactured by winding the contact member 152 on the shaft section 51 while changing the winding pitches in the end side portions 171 and the intermediate portion 172. Accordingly, the image forming station 120 is excellent in easiness of manufacturing and manufacturing cost.

If the voltage applied to the charging roller 41 by the power supply 43 illustrated in FIG. 2 is the DC voltage, toner, foreign matters, and the like tend to easily adhere to the charging roller 41. However, in the image forming station 120, the charging roller 41 can be maintained clean by the cleaning member 142.

Figure 5:
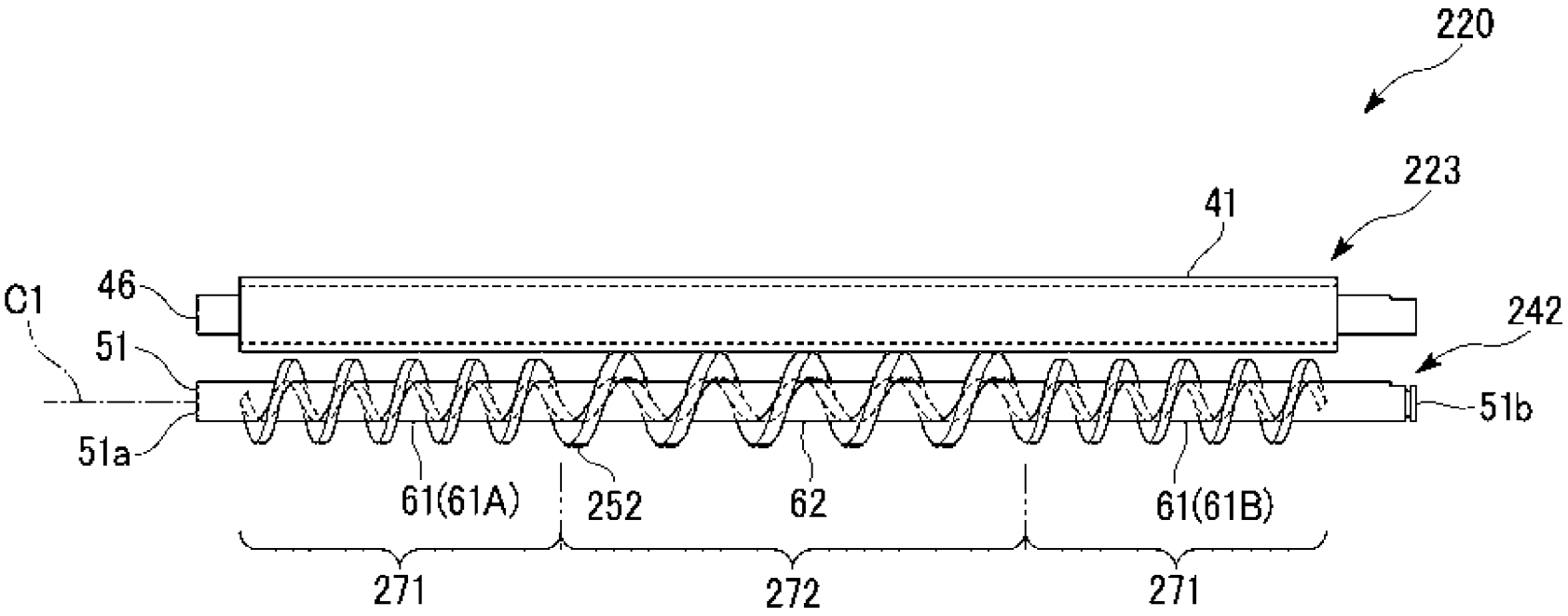
FIG. 5 illustrates a front view of a charging device of an image forming unit in a reference example.

FIG. 5 illustrates a front view of an electrostatic charger 223 of an image forming station 220 in a reference example. Description is omitted concerning components common to the embodiments described above.

As illustrated in FIG. 5, a cleaning member 242 of the electrostatic charger 223 includes the shaft section 51 and a contact member 252.

The cleaning member 242 has the same configuration as the configuration of the cleaning member 42 illustrated in FIG. 3 except that the outer diameter of an intermediate portion 272 is larger than the outer diameter of end side portions 271.

The cleaning member 242 can reduce deviations of a contact area and a pressing force of the contact member 252. Therefore, it is possible to sufficiently clean the charging roller 41 in a wide range in the length direction. Accordingly, it is possible to reduce defects of images due to charging unevenness of the charging roller 41 and obtain satisfactory image quality. Since the charging roller 41 can be sufficiently cleaned, it is possible to suppress noise occurrence due to resonance.

EXAMPLES

Examples 1 to 3

The image forming station 20 including the electrostatic charger 23 illustrated in FIG. 3 was manufactured. Images were formed on 150,000 sheets using the image forming apparatus (see FIG. 1) including the image forming station 20. Detailed specifications are illustrated in Table 1. Presence or absence of concentration unevenness of toner and vertical streaks in 35,000th sheet, 70,000th sheet, and 150,000th sheet from the start of image formation was checked. Results are illustrated in Table 1. The length of one end portion range 61 is equivalent to approximately 37% with respect to the total length of the shaft section 51. The length of the intermediate range 62 is equivalent to approximately 28% with respect to the total length of the shaft section 51.

Example 4

The image forming station 120 including the electrostatic charger 123 illustrated in FIG. 4 was manufactured. The same test as the test in the example 1 was performed using the image forming apparatus (see FIG. 1) including the image forming station 120. Detailed specifications and results are illustrated in Table 1.

Example 5

The image forming station 120 including the electrifying electrostatic charger 123 illustrated in FIG. 5 was manufactured. The same test as the test in the example 1 was performed using the image forming apparatus (see FIG. 1) including the image forming station 120. Detailed specifications and results are illustrated in Table 1.

Comparative Examples 1 to 3

Figure 6:
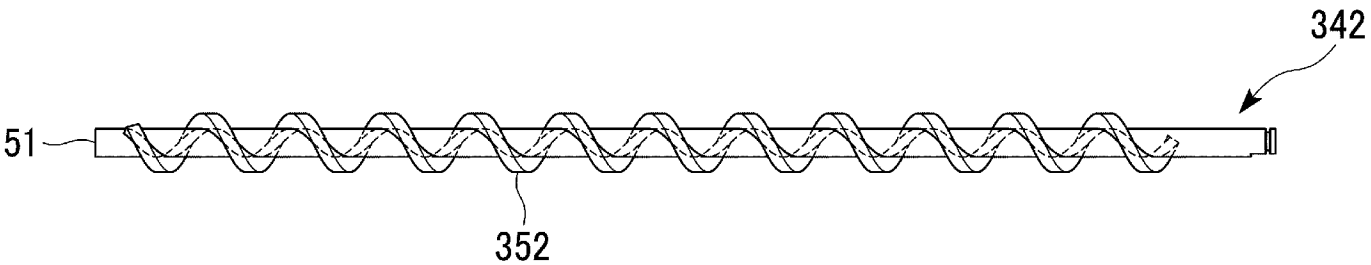
FIG. 6 illustrates a front view of a cleaning member of an image forming unit in comparative examples.

FIG. 6 is a front view of a cleaning member of an image forming unit in comparative examples. As illustrated in FIG. 6, an image forming station including a cleaning member 342 having a fixed line width and a fixed pitch of an outer circumferential surface of a contact member 352 was manufactured. The same test as the test in the example 1 was performed using an image forming apparatus including the image forming station. Detailed specifications and results are illustrated in Table 1.

| | | Material of the contact member | Outer diameter of the shaft section (mm) | Pitch (mm) | Outer diameter of the contact member (mm) | Width of the contact member (mm) | Length (mm) | Image on the 35,000th sheet | | Image on the 70,000th sheet | | Image on the 150,000th sheet | |
|---|---|---|---|---|---|---|---|---|---|---|---|---|---|
| | | | | | | | | Concentration unevenness | Vertical streak | Concentration unevenness | Vertical streak | Concentration unevenness | Vertical streak |
| Example 1 | Intermediate portion | Foamed urethane | 6 | 38.5 | 10.6 | 10 | 90 | ○ | ○ | ○ | ○ | ○ | ○ |
| | End side portions | | | 38.5 | 10.6 | 5 | 115 each | | | | | | |
| Example 2 | Intermediate portion | Foamed melamine | 6 | 38.5 | 10.6 | 5 | 90 | ○ | ○ | ○ | ○ | Δ | ○ |
| | End side portions | | | 38.5 | 10.6 | 3 | 115 each | | | | | | |
| Example 3 | Intermediate portion | Foamed melamine | 6 | 38.5 | 10.6 | 10 | 90 | ○ | ○ | ○ | ○ | ○ | ○ |
| | End side portions | | | 38.5 | 10.6 | 5 | 115 each | | | | | | |
| Example 4 | Intermediate portion | Foamed urethane | 6 | 28 | 10.6 | 5 | 90 | ○ | ○ | ○ | ○ | Δ | ○ |
| | End side portions | | | 38.5 | 10.6 | 5 | 115 each | | | | | | |
| Example 5 | Intermediate portion | Foamed urethane | 6 | 38.5 | 12.6 | 5 | 90 | ○ | ○ | ○ | ○ | ○ | ○ |
| | End side portions | | | 38.5 | 10.6 | 3 | 115 each | | | | | | |

-continued

| | | Material of the contact member | Outer diameter of the shaft section (mm) | Pitch (mm) | Outer diameter of the contact member (mm) | Width of the contact member (mm) | Length (mm) | Image on the 35,000th sheet | | Image on the 70,000th sheet | | Image on the 150,000th sheet | |
|---|---|---|---|---|---|---|---|---|---|---|---|---|---|
| | | | | | | | | Concentration unevenness | Vertical streak | Concentration unevenness | Vertical streak | Concentration unevenness | Vertical streak |
| Comparative example 1 | Intermediate portion | Foamed urethane | 6 | 38.5 | 10.6 | 5 | — | ○ | ○ | ○ | Δ | Δ | Δ |
| | End side portions | | | 38.5 | 10.6 | 5 | — | | | | | | |
| Comparative example 2 | Intermediate portion | Foamed melamine | 6 | 38.5 | 10.6 | 5 | — | ○ | ○ | Δ | Δ | Δ | × |
| | End side portions | | | 38.5 | 10.6 | 5 | — | | | | | | |
| Comparative example 3 | Intermediate portion | Foamed urethane | 4 | 29 | 8.3 | 5 | — | Δ | Δ | × | × | × | × |
| | End side portions | | | 29 | 8.3 | 5 | — | | | | | | |

*○: not occurred,
Δ: occurred a little,
x: occurred

As illustrated in Table 1, in the examples 1 to 4, it has been found that occurrence of concentration unevenness and vertical streaks can be suppressed.

The cross-sectional shape of the contact member orthogonal to its length direction is not limited to a rectangular shape. The cross-sectional shape of the contact member may be a or comprise a circular shape, an elliptical shape, a triangular shape, or the like.

If the contact member satisfies the condition (1) described above, the pitch of the contact member may be smaller in a portion closer to the center of the shaft section along the length direction. If the contact member satisfies the condition (2) described above, the width of the outer circumferential surface of the contact member may be larger in a portion closer to the center in the length direction of the shaft section.

The image forming apparatus may be a monochrome image forming apparatus. The number of image forming stations is not particularly limited. The image forming apparatus may be of a type that transfers a toner image onto a sheet directly from the photoconductive body rather than by an intermediate transfer belt or the like. The image forming apparatus may include a plurality of printer sections.

According to at least one embodiment described above, it is possible to secure a contact area of the contact member with the charging roller and a pressing force of the contact member against the charging roller even in the intermediate (central) portions of the charging roller. Therefore, it is possible to reduce deviations of the contact area and the pressing force of the contact member along the length direction of the cleaning member. Therefore, it is possible to sufficiently clean the charging roller in a wide range along the length direction. Accordingly, it is possible to reduce defects in images due to charging unevenness of the charging roller and obtain satisfactory image quality. Since the charging roller can be sufficiently cleaned, it is possible to suppress occurrence noise due to resonance.

While certain embodiments have been described these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An image forming apparatus, comprising:

a photoconductive drum on which a toner image is to be formed;

a charging roller positioned to contact a surface of the photoconductive drum and configured to charge the surface of the photoconductive drum; and a cleaning member configured to contact a surface of the charging roller, the cleaning member including a shaft extending along a rotational axis and a spiral portion spiraling around the shaft along a length of the shaft parallel to the rotational axis, wherein the spiral portion includes an edge surface that extends in a direction of the rotational axis and contacts the surface of the charging roller, and a width of the edge surface at a central region of the cleaning member is greater than a width of the edge surface at an end region of the cleaning member.

2. The image forming apparatus according to claim 1, wherein the spiral portion comprises an elastically compressible-deformable material.

3. The image forming apparatus according to claim 1, wherein the spiral portion is foamed resin.

4. The image forming apparatus according to claim 1, wherein the shaft is metal.

5. The image forming apparatus according to claim 1, wherein an outer diameter of the shaft is equal to or greater than 4 mm and less than 6 mm.

6. The image forming apparatus according to claim 1, wherein a length of the shaft in the extending direction is equal to or greater than 250 mm.

7. The image forming apparatus according to claim 1, wherein a pitch of the spiral portion at the central region is greater than a pitch of the spiral portion at the end region.

8. An image forming apparatus, comprising:

a photoconductive drum on which a toner image is to be formed;

a charging roller positioned to contact a surface of the photoconductive drum and configured to charge the surface of the photoconductive drum; and a cleaning member configured to contact a surface of the charging roller, the cleaning member including a shaft extending along a rotational axis and a spiral portion spiraling around the shaft along a length of the shaft parallel to the rotational axis, wherein the spiral portion includes an edge surface that extends in a direction of the rotational axis and contacts the surface of the charging roller, a pitch of the spiral portion at a central region of the cleaning member is less than a pitch of the spiral portion at an end region of the cleaning member, and a width of the edge surface at the central region is less than a width of the edge surface at the end region.

9. The image forming apparatus according to claim 8, wherein the spiral portion comprises an elastically compressible-deformable material.

10. The image forming apparatus according to claim 8, wherein the spiral portion is foamed resin.

11. The image forming apparatus according to claim 8, wherein the shaft is metal.

12. The image forming apparatus according to claim 8, wherein an outer diameter of the shaft is equal to or greater than 4 mm and less than 6 mm.

13. The image forming apparatus according to claim 8, wherein a length of the shaft in the extending direction is equal to or greater than 250 mm.

14. An image forming apparatus comprising:

a photoconductive drum on which a toner image is to be formed;

a charging roller positioned to contact a surface of the photoconductive drum and configured to charge the surface of the photoconductive drum; and a cleaning member configured to contact a surface of the charging roller, the cleaning member including a shaft extending along a rotational axis and a spiral portion spiraling around the shaft along a length of the shaft parallel to the rotational axis, wherein the spiral portion includes an edge surface that extends in a direction of the rotational axis and contacts the surface of the charging roller, a total area of the edge surface per unit length of the shaft along the rotational axis in a central region of the cleaning member is greater than a total area of the edge surface per unit length of the shaft along the rotational axis in an end region of the cleaning member, and a width of the edge surface at the central region of the cleaning member is greater than a width of the edge surface at the end region of the cleaning member.

15. The image forming apparatus according to claim 14, wherein the spiral portion comprises elastically compressible-deformable material.

16. The image forming apparatus according to claim 14, wherein the spiral portion of the cleaning member is foamed resin.

17. The image forming apparatus according to claim 14, wherein the shaft is metal.

18. The image forming apparatus according to claim 14, wherein a pitch of the spiral portion at the central region of the cleaning member is greater than a pitch of the spiral portion at the end region of the cleaning member.

* * * * *